United States Patent [19]

Rizza

[11] Patent Number: 4,781,003

[45] Date of Patent: Nov. 1, 1988

[54] EXPANSION JOINT SEAL, FRAME AND ASSEMBLY

[76] Inventor: Michael Rizza, 2863 Encina Camino, Walnut Creek, Calif. 94598

[21] Appl. No.: 786

[22] Filed: Jan. 6, 1987

[51] Int. Cl.[4] ..... E01C 11/02

[52] U.S. Cl. ..... 52/396; 52/98; 52/403; 52/573; 404/69

[58] Field of Search ..... 52/393, 395, 396, 403, 52/98, 573; 404/65-69

[56] References Cited

U.S. PATENT DOCUMENTS

| | | | |
|---|---|---|---|
| 2,954,592 | 10/1960 | Parsons . | |
| 3,024,504 | 3/1962 | Miller . | |
| 3,172,237 | 3/1965 | Bradley | 52/396 X |
| 3,302,690 | 5/1964 | Hurd | 160/40 |
| 3,378,958 | 4/1968 | Parks et al. | 49/489 |
| 3,720,142 | 3/1973 | Pare | 52/396 X |
| 3,742,669 | 7/1973 | Mansfeld | 52/396 |
| 4,007,994 | 2/1977 | Brown | 52/396 X |
| 4,290,713 | 9/1981 | Brown et al. | 404/69 |
| 4,533,278 | 8/1985 | Corsover et al. | 52/98 X |

*Primary Examiner*—J. Karl Bell

*Attorney, Agent, or Firm*—Townsend and Townsend

[57] ABSTRACT

An expansion joint seal assembly comprising elastomeric face and back seals joined by a tear strip and mounted between abutting adjacent building surfaces by press-fitting holding arrows integrally formed with the face and back seals into corresponding receptacles in a retaining frame mounted to each of the building surfaces. The elastomeric face and back seals are provided with accordion-like surface contours that allow the space between the abutting building surfaces to expand and contract due to thermal expansion, wind drift, settling and seismic motions upon the building structure while maintaining an impervious seal. The elastomeric face and back seals and tear strip are produced from a single extrusion of a flexible material, and may be of a type susceptible of coloration.

17 Claims, 1 Drawing Sheet

EXPANSION JOINT SEAL, FRAME AND ASSEMBLY

BACKGROUND OF THE INVENTION

1. Field of the Invention

The present invention relates generally to sealing devices, and more particularly to an improved expansion joint seal used to protect areas between abutting building surfaces from moisture and foreign material, that allows independent movement of each building surface.

2. Description of the Relevant Art

Expansion-type joint seals of a wide variety have been used in construction for some time. Typically, when large structures are constructed allowance for expansion and contraction of the building materials due to thermal variations and motion of the structure due to seismic activity and climatic conditions (i.e. wind) must be made. A common method for making such allowances is to construct the structure leaving gaps, called joints, in sections of the structure. In this method discrete sections of the structure are left free to move independently of one another so as to distribute any expansion or contraction of the building material, or other motion due to seismic activity, climatic conditions or the like.

When joints are provided in the structure steps must be taken to isolate the internal environment of the structure from the external environment. It is especially important to seal the internal environment from water, dirt and other foreign material which may affect heating, ventilation, electrical interconnection, interior fixtures and the like. A requirement of any seal used in such cases is that it be capable of expanding and contracting to accommodate motion of the structure while maintaining its imperviousness.

In the past such seals have comprised single strips of weather resistant synthetic rubber, such as neoprene, extended between opposing structural surfaces, such as that described in U.S. Pat. No. 4,290,713 (Brown et al.). Effective integrity of the seal over significant variations in joint width is presently preferably achieved by contouring the seal in an accordion-like fashion, or forming the seal with a serpentine cross section. Such a configuration is contrary to the aesthetic desire to present as flat and uniform a surface as possible of increased importance when the seal is used in interior applications. One variation on the basic concept includes utilizing double seals to achieve improved flexibility of the seal while presenting an aesthetically pleasing surface. A manifold contoured rear seal designed to maximize seal integrity and a minimally contoured face seal designed for aesthetic appeal are typically provided. The disadvantage of the double seal arrangement is that the rear seal must be fully installed before the front seal may be installed Thus, the installation time involved in the double seal arrangement is at least doubled. Whereas use of a prior art single seal is a trade-off between aesthetic appearance and integrity of the seal, prior art double seal devices are a trade-off between aesthetic appearance and ease and speed of installation.

The expansion joint seal according to the present invention provides a pleasing aesthetic appearance, integrity of seal and minimal installation time as well as: dual durometer seals, harder at those points where the seal is secured to the structure's surfaces; lower cost of production, only one die required for fabricating the seal; and, greatly improved resistance to deformation and sagging in both vertical and horizontal installations. The frame, mounted to the building surfaces, to which the seal is attached also provides the advantages of allowing securing of the frame to the building surface using a diagonally installed screw, tie or the like, especially helpful in narrow installations, and accommodations for mounting the frame to non-flush surfaces.

SUMMARY OF THE INVENTION

The present invention provides an expansion joint seal for protecting areas between abutting building surfaces from moisture and foreign material having a face and back seal, joined by a tear strip, and a frame, attached to the abutting building surfaces, for receiving the seal. The face seal is made of an elastomeric material and provided with one or more accordion-like contours to allow it to laterally expand and contract, It is further provided with slots for accepting corner angles to facilitate maintaining a continuous face seal surface as the expansion joint seal bends around corners and the like. Lugs are provided to facilitate use of a spring clip in inverted horizontal installations, such as ceilings, to help eliminate sagging of the seal. Finally, the face seal is provided with a number of continuous arrow-shaped fasteners, called holding arrows, that are inserted into correspondingly shaped receptacles in the frame to hold the face seal in place.

The back seal is, as well, provided with a number of accordion-like contours and with holding arrows. However, the back seal will generally be provided with a greater number of contours and the holding arrows will be larger than in the corresponding face seal so as to provide improved integrity of the back seal when subjected to expansion and contraction.

The holding arrows of both the face and back seals are integrally formed with each seal. They may be formed of the same material as the seals themselves or, in a presently preferred embodiment, may be formed of a harder material than the seals to provide the holding arrows with improved resistance to disengagement from the frame. The seal is continuous along the entire length of installation, following the profile of the structure to which it is installed.

The frame is made up of left and right side sections. Each section has a number of channels formed along its length, one for accommodating the holding arrows of the front seal, one for those of the back, and the third for accepting a hook-on clip that is used when the seal is to be mounted to other than a flush surface. Provision is made in the frame for applying a continuous sealant between the frame and the building surface to further improve the integrity of the seal. Optionally, a spring clip is secured to the frame for use in inverted horizontal installations. In these cases the back seal may be separated from the face seal along the tear strip. The face seal is used alone as in a standard installation, except that the lugs on its back face are engaged with the spring clip, and thus the seal is further supported to reduce sagging.

Further features and advantages of the present invention will become apparent in consideration of the following specification in light of the provided drawings.

DETAILED DESCRIPTION OF TH PREFERRED EMBODIMENT

Figure 1:
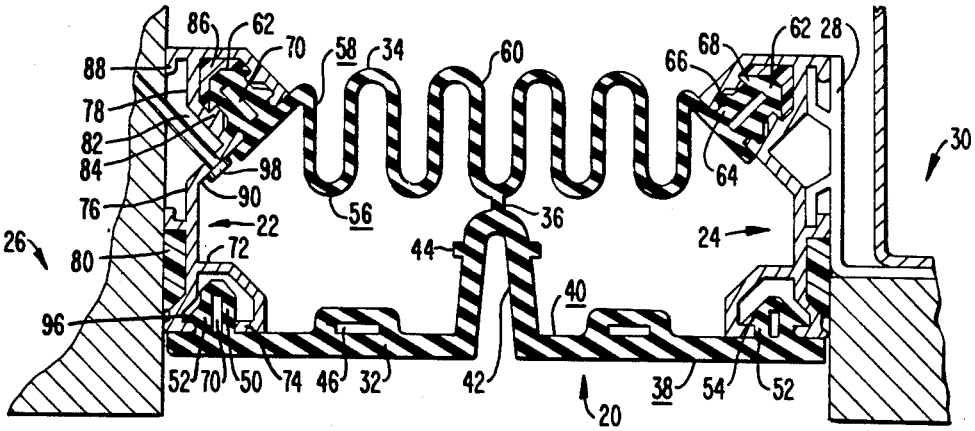
FIG. 1 is a cross-sectional view of an expansion joint seal assembly according to the teachings of the present invention illustrating an expansion joint seal, frame, hang-on clip and relative locations of flush and non-flush building surfaces.
Figure 2:
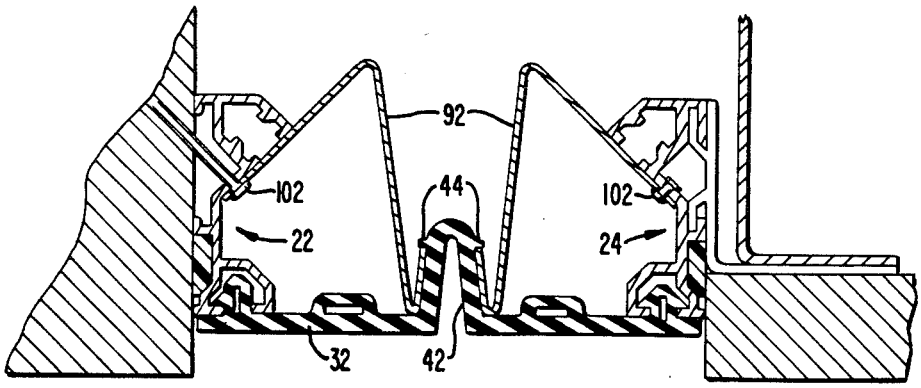
FIG. 2 is a cross-sectional view of an expansion joint seal assembly according to the teachings of the present invention, illustrating a spring clip and lug installation of the seal.

The general arrangement of an expansion joint seal assembly according to the teachings of the present invention is shown in FIG. 1. The assembly comprises expansion joint seal 20 connected to left frame side 22 and right frame side 24. Left frame side 22 is shown mounted to a flush building surface 26, while right frame side 24 is shown mounted to a hook-on clip 28 which is in turn mounted to a non-flush building surface 30. The assembly as shown may be installed in either exterior or interior applications, and at any angle between horizontal and vertical.

In a preferred embodiment the expansion joint seal comprises a first seal, for example a face seal 32, a second seal, for example a back seal 34 and a tear strip 36 joining them. The first and second seals are formed of an elastomeric material such as neoprene. EPDM, silicone or thermal plastics (PVC, TPE, TPO, etc.). Use of properly selected material allows a desired balance between color, elasticity, wear-life, ease of installation and cost of the seal.

Figure 3:
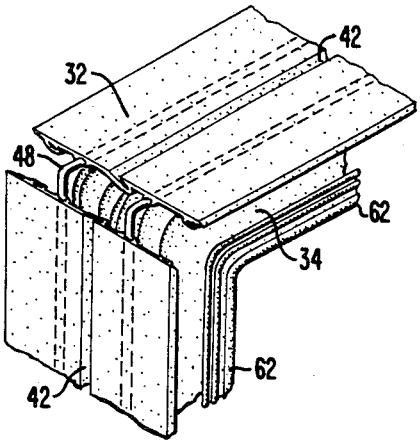
FIG. 3 is a perspective view of an expansion joint seal at a corner location detailing a miter-cut face seal, corner angles and a continuous back seal.

The first seal 32 has a front face 38 and back face 40 and may be provided with a number of accordion-like contours, in a presently preferred embodiment only one such contour 42 is provided so as to present an aesthetically appealing flat front surface. Disposed on the back face 40 of the first seal 32 at a centrally located contour are lugs 44. The lugs may be quarterround, triangular, rectangular or other shape having at least one flat surface for engaging a spring-type hanging clip. Generally, a pair of such lugs are provided and align parallel to the plane of the first seal so as to point away from one another. The first seal is also provided with means 46 for accepting of corner angles 48 (FIG. 3) to facilitate maintaining a continuous first seal as the expansion joint seal is bent around corners. A number of rectangular channels formed in the first seal, preferably extending from back face 40 towards second seal 34, are presently preferred means for engaging the corner angles. Generally two, but often more, of the corner angle securing means are provided and are generally midway along the plane of the seal between the centralized contour 42 and the building surfaces.

As previously mentioned, the first seal is held in place between abutting building surfaces by a frame, as designated left frame side 22 and right frame side 24. Means for securing the first seal to the frame sides preferably comprise elastomeric arrow-shaped fingers referred to as front holding arrows 50 integrally formed with, and located substantially at each lateral edge of, the first seal. The front holding arrows are made up of a shaft 52 extending from the back face 40 in a direction away from the front face 38. Attached to the shaft 52 is a substantially triangular-shaped member 54. The shaft and triangular-shaped member are attached to each other at a wide base of the triangular-shaped member such that the base of the member extends wider than and evenly overhangs each side of the shaft 52. The front holding arrows 50 run substantially the entire length of the expansion joint seal, and are oriented towards the second seal 34 generally perpendicular to the plane of the first seal.

In one embodiment of the present invention one of the two lengths of front holding arrows 50 is, rather than the symmetrical shape defined above, asymmetrical. It similarly is made up of a shaft 52, but instead of a triangular member being attached to the shaft at its wide base, the triangular member is attached on one side of the shaft. The triangular member in this embodiment labeled with reference number 96, is of a smaller size than that of triangular member 54 disposed on the second front holding arrow 50. The basis for this embodiment is that when sufficient movement between the abutting building surfaces occurs that is beyond the extension capabilities of the front holding arrows a predetermined one of the front holding arrows disengages the frame. This simplifies reinstallation of the seal in such circumstances.

The second seal 34 likewise has a front face 56 and a back face 58. As well, the second seal is provided with a number of accordion-like contours 60, and in the presently preferred embodiment more than one of such contours are provided. Means for securing the second seal to the frame are provided in a similar manner to that of the first frame, preferably comprising elastomeric arrow-shaped fingers referred to as back holding arrows 62, integrally formed with the second seal. These back holding arrows 62 are made up of a shaft 64 extending from the back face 58 of the second seal 34 in a direction away from front face 56. Attached to the shaft 64 are substantially triangular-shaped members 66 and 68 preferably wider than triangular-shaped member 54. Shaft 64 and triangular member 66 are attached to one another at a wide base of the triangular-shaped member 66 such that the base of the member extends wider than and evenly overhangs each side of the shaft 64. Triangular-shaped member 66 and triangular-shaped member 68 are attached to one another at a wide base of the triangular-shaped member 68 and a narrow portion near the apex of triangular-shaped member 66. In this way the wide base of triangular-shaped member 68 extends wider than and overhangs the width of the section of triangular-shaped member 66 where triangular-shaped member 66 attaches to triangular-shaped member 68. In this manner stacked double holding arrows are provided for greater interlock strength between the second seal 34 and the frame. The back holding arrows 62 run substantially the entire length of the expansion joint seal, and may extend generally in the same direction as front holding arrows 50, or preferably at an angle, for example 45°, for ease of installation.

A central hollow 70 may be provided in each front holding arrow 50 and back holding arrow 62 to allow each front and back holding arrow to compress for ease of insertion into the frame.

A tear strip 36 is provided in the inner region between the back face 40 of the first seal 32 and the front face 56 of the second seal 34 which connects the first and second seals. Preferably, the tear strip 36 joins front and back seals at a central contour 42 on the first seal disposed towards the second seal and a corresponding central contour on the second seal disposed towards the first seal. In this manner the width of the tear strip between the first and second seals is minimized to increase the strength of the interconnection between the first and second seals and reduce the cost by reducing the amount of material used.

The combination of first and second seals and tear strip is preferably integrally formed using a single die. Methods well known in the art for achieving dual hardness of elastomeric material during the forming process may be utilized to achieve a dual hardness seal as described above.

The frame to which the expansion joint seal is secured is made up of two independent halves, referred to as left frame side 22 and right frame side 24. Each half is basically a mirror image of the other, thus a detailed description of one half is equally applicable to the other half. Arbitrarily taking the left half in detail, it is made up of a number of channel sections optimally arranged for greatest convenience and flexibility of use. A first channel section 72 is located adjacent to a building surface and oriented so as to open substantially parallel to the plane of that surface. This first channel section 72 will serve to accept the front holding arrows 50 on the first seal 32. A pair of lips 74 are provided on the face of the opening of the channel 72 that extend perpendicular to the opening so as to provide a surface for engaging the front holding arrows. A flat section 76 of frame extends in a direction parallel to the plane of the building surface to connect the first channel section to a second channel section 78 defining an area in which continuous sealant 80 may be applied between the building surface and the frame for increasing the effectiveness of the seal, and in a preferred embodiment for defining a third channel section 82. The second channel section 78 includes lips 84 disposed on each flange for engaging the previously described double arrowhead configuration of the back holding arrows 62 of the second seal 34. For ease of installation, the second channel section 78 is preferably oriented at an angle to the plane of the building surface, for example 45°. Further, the second channel section is preferably fabricated so as to allow an area 86 for accepting continuous sealant when the back holding arrows 62 are inserted therein.

The preferred third channel section 82 includes lips 88 that overhang the flanges of the channel for engaging a hook-on clip 28. This third channel section is aligned to open perpendicular to the plane of and toward the building surface. Integral with the definition of the third channel section is angled face 90. This face is positioned so as to receive a fastener means such as a screw, tie or the like for securing the frame side to the building surface. It is angled away from the plane of the building surface, for example at 45°, to increase the convenience of installing the frame in narrow areas between abutting building surfaces.

Each of the frame sides 22 and 24 may be secured to the corresponding building surface in one of a number of ways. First, the worker may install a frame side by positioning the frame side in its final position against the building surface and fastening the frame side in position at angled face 90 by screw, tie or similar fastening means 98. This is a preferred method of securing the frame side when the building surface to which the frame side is to be attached is flush.

However, when the building surface to which the frame side is to be attached is non-flush, use of a hook-on clip 28 is preferred. The hook-on clip comprises a flat surface appropriately sized to engage third channel section 82 connected to a section of appropriate size and shape for engaging the contour of the building surface. The hook-on clip itself is initially secured to frame 24 at third channel section 82. In either flush or non-flush cases as each frame side is secured to the building surface, a continuous sealant is applied between the frame and the building surface in an area 80 disposed to receive the continuous sealant.

An alternative method of fastening frame sides to the building surfaces involves use of combination sealant and adhesive. When such is the case, the step of securing the frame with screw, tie or similar fastening means at angled face 90 is replaced entirely with the step of introducing a sealant into region 80. Whereas in the case of fastening with screw, tie or otherwise, where a soft sealant such as butyl is used, a harder sealant such as urethane that serves as both a sealant and adhesive is used.

In applications where the seal is to be installed in an inverted horizontal position, a number of optional spring clips 92 are secured to each frame side. Preferably, the spring clips are secured at a common point 102 where each frame side is secured to the building surface for simplicity, economy and speed of installation. The frame is apart from attaching the spring chips, secured to the building surface as above, including application of the continuous sealant in area 80. Although a standard frame as discussed above is the preferred frame for use in any application of the expansion joint seal according to the present invention, a modified frame comprising only the elements of a first channel member 72, securing means 90 to secure the frame to a building surface and a spring clip 92 may just as effectively be used in inverted horizontal applications since only the first elastomeric seal 32 is used in the inverted horizontal applications as further disclosed below.

Having installed each respective frame side, and where appropriate, the spring clips, the worker proceeds to install the expansion joint seal. In the case where spring clips are not used, this is accomplished by first applying a continuous sealant in the region 86 of the second channel sections and inserting back holding arrows 62 into each corresponding second channel section over a short distance. Ideally, upon insertion the holding arrows 62 lockingly engage second channel sections 78. The worker will then engage front holding arrows 50 into corresponding first channel sections 72 along approximately the same length as the back holding arrows 62 have been installed. Ideally, front holding arrows 50 lockingly engage first channel sections 72 to hold the first seal 32 firmly in place. In certain installations, especially where the seal is to be installed vertically over a long distance, the lips 74 may be deformed by peening, pinching, etc. at certain points, for example every 5 feet, to help prevent the seal's settling out of its installed position under its own weight. Thus, a length of both the first seal 32 and second seal 34 has been installed into the area between abutting building surfaces. Such procedure is repeated until the length of seal is fully installed.

In the event that the seal is to be installed in an inverted, horizontal position, the installation utilizes spring clips secured during installation of the frame as mentioned above. In this configuration the worker removes the second seal 34 from the first seal 32 at tear strip 36. Second seal 34 is discarded as first seal 32 will be used alone. The worker installs the first seal 32 by engaging front holding arrows 50 into first channel section 72 and additionally engages lugs 44 into spring clips 92.

When the expansion joint seal is to be mounted at a corner or other predetermined location where the seal is intended to bend, corner angles are used. In this installation the seal, in either the standard or inverted horizontal arrangement, is installed as discussed above. When a corner or other predetermined point of bend is reached, the front seal is miter-cut at that point. Corner angles 48 are engaged into the means 46 for receiving the corner angles. Corner angles are selected to have bends at an angle that correspond to the desired bend in the seal. The mitered portions of the face seal are then brought together, each engaging corresponding corner angles. Appropriate sealant is then applied at the miter joint to maintain an impervious seal at the joint. It should be noted that although a miter-cut is provided in the first seal 32, the second seal 34 remains uncut and intact. Further, first seal 32 and second seal 34 remain joined at the tear strip 36. Maintaining the connection between the first seal and second seal aids in supporting the second seal from sagging at the corners, and together with the fact that second seal 34 remains continuous over the corner, an impervious seal at the corner is thus provided.

Figure 4:
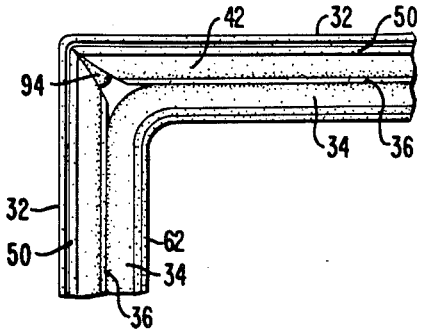
FIG. 4 is a side view of an alternate embodiment of an expansion joint seal according to the teachings of the present invention.

Alternatively, when the seal 20 is to be mounted at a corner or other bend, a notch is cut at the point of bend in contour 42 and tear strip 36, as shown in FIG. 4. Front seal 32 and back seal 34 remain uncut. Seal 20 is then secured to the frame as discussed above. Sealant 94 is then applied from the outside of seal 20 at the point where contour 42 has been notched. This provides a degree more of imperviousness, and a less time consuming installation at corners, because less of seal 20 needs to be cut and sealed with sealant.

In operation, when minor movement between the building surfaces to which an expansion joint seal is secured occurs, the first seal 32 and second seal 34 take up the movement by expanding or contracting as appropriate and remain affixed to the frame at respective locations. When relatively large movement occurs between the building surfaces, the first seal may disengage when it reaches the limits of its expansion without tearing. The second seal is capable of opening to a much larger width than the first seal and will stay affixed to the frame even in such situations. When the building surface motion has subsided the front seal can then easily be reinstalled by reinserting an appropriate front holding arrow or arrows 50 into appropriate first channel sections 72 as with initial installation procedures. Similarly, in the event that the expansion joint seal is installed in an inverted horizontal position and spring clips are utilized, should the expansion joint seal disengage the spring clips, it may easily be reinstalled per the above-described installation procedures.

In some applications, it will be desirable to extend the expansion joint seal down to approximately one-quarter inch above ground level. A gap of approximately one-quarter inch may be left between the ground surface and lowest edge of the front seal 32, while the second seal 34 extends down to contact the ground surface to allow any trapped moisture or foreign material to escape the interior region of the expansion joint seal. Drain sections serving a similar purpose may be installed at other points along the seal, including inverted horizontal applications, as appropriate.

To those skilled in the art to which the invention relates, many changes in construction and application and widely differing embodiments and combinations of the present invention will suggest themselves without departing from its spirit and scope. The disclosures and descriptions herein are merely illustrative and not intended to be in any sense limiting.

What is claimed is:

1. An expansion joint seal, for protecting the areas between abutting building surfaces from moisture or foreign material, which allows independent movement of each building surface, comprising:

first and second seals of elastomeric composition for prevention of intrusion of moisture and foreign material into the area between abutting building surfaces, said first and second elastomeric seals having at least one accordian-like contour intergrally formed in their surface;

at least one tear strip located in an inner region between said first and second seals and affixed to each for maintaining close proximity between said first and second seals;

means for securely affixing a plurality of corner angles to said first seal to facilitate maintaining a continuous first seal surface as the expansion joint seal deviates from linerity at predetermined points along its length; and means for retaining the lateral edges of said first and second seals in proximate contact with abutting building surfaces such that intrusion of moisture and foreign material into an area between the abutting building surfaces is prevented.

2. The expansion joint seal according to claim 1, further comprising lug means located on a contour of a face of said first seal that is disposed towards said second seal for accepting a hook-on clip.

3. The expansion joint seal according to claim 1, wherein said retaining means comprise holding arrows which are substantially continuous along the entire length of the expansion joint seal.

4. The expansion joint seal according to claim 3, wherein the material used to form said holding arrows is durometrically harder than the material used to form said first and second seals.

5. An expansion joint seal, for protecting the areas between abutting building surfaces from moisture or foreign material, which allows independent movement of each building surface, comprising:

an elastomeric face seal and elastomeric back seal for preventing intrusion of moisture and foreign material into the area between abutting building surfaces, said elastomeric face and elastomeric back seal having at least one accordian-like contour integrally formed in their surfaces for allowing independent movement of the abutting building surfaces while maintaining a protective seal of the area between the abutting building surfaces;

a tear strip joining said elastomeric face and back seals at a central contour on said face seal directed toward said back seal with a central contour on said back seal directed toward said face seal along the length of the expansion joint seal for maintaining close proximity between said elastomeric face and back seals;

means for securely affixing a plurality of corner angles to said face seal to facilitate maintaining a continuous face seal surface as the expansion joint seal diviates from linearity at predetermined points along its length; and means for retaining the lateral edges of said elastomeric face and back seals in proximate contact with the abutting building surfaces capable of preventing intrusion of moisture and foreign material into an area between the abutting building surfaces.

6. The expansion joint seal according to claim 5, further comprising lug means located on a contour of said face seal that is disposed towards said back seal for accepting a hanging clip.

7. The expansion joint seal according to claim 5, wherein said retaining means comprise holding arrows disposed at each lateral edge of said face and back seals substantially continuous along the length of the expansion joint seal.

8. The expansion joint seal according to claim 7, wherein the material used to form said holding arrows is durometrically harder than the material used to form said face and back seals.

9. The expansion joint seal according to claim 7, wherein a first of said holding arrows is smaller than a second of said holding arrows.

10. The expansion joint seal according to claim 9, wherein said holding arrows disposed on said face seal are smaller than said holding arrows disposed on said back seal.

11. An expansion joint seal for protecting areas between abutting building surfaces from moisture and foreign material, which allows independent movement of each building surface, comprising:

an elastomeric face seal and elastomeric back seal disposed substantially the entire length of and within an area defined between abutting building surfaces for preventing intrusion of moisture and foreign material into an area between abutting building surfaces, said elastomeric face seal and elastomeric back seals having at least one accordion-like contour integrally formed in their surfaces for allowing independent movement of the abutting building surfaces while maintaining a protective seal of the area between the abutting building surfaces;

a tear strip located between said elastomeric face and back seals such that the tear strip joins a central contour on said face seal directed towards said back seal with a central contour on said back seal directed towards said face seal along the length of the entire expansion joint seal, for maintaining close proximity between said face and back seals;

holding arrows disposed at each lateral edge of each of said face and back seals substantially continuous along the entire length of the expansion joint seal for retaining said elastomeric face and back seals in proximate contact with a frame attached to abutting building surfaces;

means for securely affixing a plurality of corner angles to said face seal to facilitate maintaining a continuous face seal surface as the expansion joint seal deviates from linearity at predetermined points along its length; and lug means located on a contour of said face seal oriented towards said back seal forming fingers that are disposed substantially perpendicular to the plane of said face seal for accepting a hanging clip.

12. The expansion joint seal according to claim 11, wherein the material used to form said holding arrows is durometrically harder than the material used to form said face and back seals.

13. The expansion joint seal according to claim 11, wherein a first of said holding arrows is smaller than a second of said holding arrows.

14. The expansion joint seal according to claim 11, wherein said holding arrows disposed on said front seal are smaller than said holding arrows disposed on said back seal.

15. An expansion joint seal of the type configured to be located between a pair of abutting building surfaces thereby defining an inner and an outer region such that the inner region between the abutting building surfaces is isolated from the outer region while independent movement of either or both abutting building surfaces is allowed, comprising:

an outer seal of elastomeric composition having one or more accordian-like contours extending along its length to allow said outer seal to expand to a first width, and having first retaining means for maintaining the lateral edges of said outer seal in surface engagement with the abutting building surfaces and means for securely affixing a plurality of corner angles to said outer seal to facilitate maintaining a continuous outer seal surface as the expansion joint seal deviates from linearity at predetermined points along its length;

an inner seal of elastomeric composition having one or more accordian-like contours extending along its length to allow said inner seal to expand to a second width greater than said first width, and second retaining means for maintaining the lateral edges of said inner seal in surface engagement with the abutting building surfaces; and interconnection means joining a central contour of said outer seal which is directed toward said inner seal with a central contour of said inner seal directed toward said outer seal.

16. The expansion joint seal according to claim 15, further comprising lug means located on a central contour of said outer seal which is directed toward said inner seal comprising first and second oppositely extending tabs for accepting a hook-on clip.

17. The expansion joint seal according to claim 15, wherein said first and second retaining means comprise first and second holding arrows, respectively, said first holding arrows being smaller than said second holding arrows, and further wherein said expansion joint seal further comprises a mounting frame secured to said abutting building surfaces for receiving said first and second holding arrows.

* * * * *